US005395216A

United States Patent [19]

Lin

[11] Patent Number: 5,395,216

[45] Date of Patent: Mar. 7, 1995

[54] PORTABLE CAR-USED OIL EXTRACTING AND TIRE INFLATION APPARATUS WITH SEPARATELY DISPOSED OIL AND AIR PUMPS

[76] Inventor: Yi-Hsien Lin, 5F., No. 13, Lane 337, Yungho Rd., Chungho City, Taipei Hsien, Taiwan, Prov. of China

[21] Appl. No.: 190,364

[22] Filed: Feb. 2, 1994

[51] Int. Cl.[6] ..... F04B 21/00

[52] U.S. Cl. ..... 417/234; 417/429

[58] Field of Search ..... 417/234, 426, 429, 350

[56] References Cited

U.S. PATENT DOCUMENTS

| | | | |
|---|---|---|---|
| 2,465,554 | 3/1949 | Roy | 417/234 |
| 2,643,614 | 6/1953 | Rosenkrans | 417/429 |
| 3,172,363 | 3/1965 | Bennett et al. | 417/429 |
| 3,196,802 | 7/1965 | Matheny | 417/429 |
| 3,871,268 | 3/1975 | Misima | 417/429 |
| 4,789,310 | 12/1988 | Hung | 417/234 |

*Primary Examiner*—Richard A. Bertsch
*Assistant Examiner*—M. Kocharov
*Attorney, Agent, or Firm*—Varndell Legal Group

[57] ABSTRACT

Disclosed is a portable car-used oil extracting and tire inflation apparatus with separately disposed oil and air pumps. A first embodiment of the apparatus mainly includes a motor with a rotary shaft on upper and lower ends thereof. The upper rotary shaft is connected by an eccentric pin to a rocker arm of an oil pump assembly disposed at an upper front portion of the apparatus. The lower rotary shaft is similarly connected to a rocker arm of an air pump assembly disposed at a lower front portion of the apparatus. When the motor is turned on the rocker arms reciprocate in linear movement, and the oil and the air pump assemblies extract and drain oil from a sump of a vehicle and inflate tires of the vehicle, respectively. A second embodiment of the apparatus has similar structure as that of the first embodiment except weighted eccentric shaft means are connected to the rotary shafts of the motor by a unidirectional bearing, and a power switch is provided to enable the motor to turn either in a first direction to actuate the oil pump assembly only, or in a second reverse direction to actuate the air pump assembly only, thereby enhancing the efficiency of the power output of the motor.

6 Claims, 7 Drawing Sheets

PORTABLE CAR-USED OIL EXTRACTING AND TIRE INFLATION APPARATUS WITH SEPARATELY DISPOSED OIL AND AIR PUMPS

BACKGROUND OF THE INVENTION

The present invention relates to a portable car-used oil extracting and tire inflation apparatus with separately disposed oil and air pumps which is an improvement on the. portable car-used oil extracting and tire inflation apparatus as disclosed in U.S. Pat. No. 5,252,033 granted to Yin-Hsien Lin on Oct. 12, 1993, and more particularly to an apparatus in which a single motor is used to drive air and an oil pumps, so that the cylinder shafts therein and pistons thereof, accordingly, are reciprocatingly moved to extract oil from an oil sump and to inflate tires, respectively. Accordingly, changing of machine oil or gasoline as well as inflating of tires can be conveniently completed.

The object of U.S. Pat. No. 5,252,033 a portable car-used oil extracting and tire inflation apparatus, is to provide an apparatus which can be conveniently carried along with a vehicle to be used as an oil drainer and a tire inflator at the same time, so that ordinary vehicle and/or motorcycle maintenance works, such as the change of machine oil and the inflation of tires, can be easily done at any place and at any time. The real value of the portable car-used oil extracting and tire inflation apparatus disclosed in U.S. Pat. No. 5,252,033 lies in that it is light and compact while it can be timely used to do the car service or maintenance, such as oil draining and tire inflation at the same time without the need of additional conventional tools for such purposes.

However, in consideration of the safety in use, it is preferable to separate the pumps for oil extracting and tire inflation so that they are not at the same side of the apparatus but at two different portions thereof, for example, while still using one single motor to drive the two separately disposed pumps.

Moreover, since the oil extracting and tire inflation are usually not done at the same time, it is preferable to allow selection of only one of the two functions, that is, oil extracting or tire inflation, at a single time by employing suitable flywheels and unidirectional bearings, which prevents wasting the energy of motion generated by the motor.

SUMMARY OF THE INVENTION

It is therefore a primary object of the present invention to provide an improved portable car-used oil extracting and tire inflation apparatus in which the oil pump and the air pump are separately disposed at an upper and a lower portion of the apparatus for convenient and safe oil extracting and tire inflation, respectively.

Another object of the present invention is to provide a portable car-used oil extracting and tire inflation apparatus in which only one single motor is required to generate power to actuate the air pump and the oil pump at the same time.

A further object of the present invention is to provide a portable car-used oil extracting and tire inflation apparatus in which the motor can be turned either in a first direction or in a second reverse direction so as to actuate the air pump or the oil pump, respectively, at a different time and thereby save output power that would be otherwise unnecessarily used to move the other pump that is not needed. The output horsepower can therefore be utilized in a more effective manner.

The improved portable car-used oil extracting and tire inflation apparatus according to the present invention has a kettle-like casing, a motor disposed inside the casing at a middle portion thereof, an oil pump assembly disposed inside the casing at an upper front portion thereof, and an air pump assembly disposed inside the casing at a lower front portion thereof. Both the oil and the air pump assemblies have a rocker arm connected to an eccentric shaft member by means of an eccentric pin while the crank shafts are separately connected to an upper and a lower rotary shaft of the motor, so that the operation of the motor drives the rocker arms to reciprocate to and fro and actuate the cylinder pistons of the oil and the air pump assemblies to extract oil from a sump of a vehicle or to inflate tires of the vehicle at the same time but at an upper and a lower position, respectively. The oil piston is provided with a graphite piston ring which together with the oil cylinder which has special power metallurgy structure to permit a long-time operation without the risk of piston ring seizure.

The eccentric crank members connected to the upper and the lower rotary shaft of the motor each can be replaced with a unidirectional bearing and a weighted eccentric crank member connected to the unidirectional bearing, such that when a power switch is pressed to enable the motor to rotate in a first direction, only the oil pump assembly is actuated to reciprocate and extract oil, and when the power switch is pressed to enable the motor to rotate in a second reverse direction, only the air pump assembly is actuated to inflate tires. Thereby, energy of motion provided by the motor would is not wasted on one of the two pump assemblies that is not in use. In addition, a force of inertia is generated by the turning of the weighted eccentric crank member that will enhance the horsepower output by the motor.

BRIEF DESCRIPTION OF THE DRAWINGS

The detailed structure of the present invention and the other advantages thereof can be best understood through the following detailed description of the preferred embodiments and the accompanying drawings wherein.

DETAILED DESCRIPTION OF THE PREFERRED EMBODIMENTS

Figure 1:
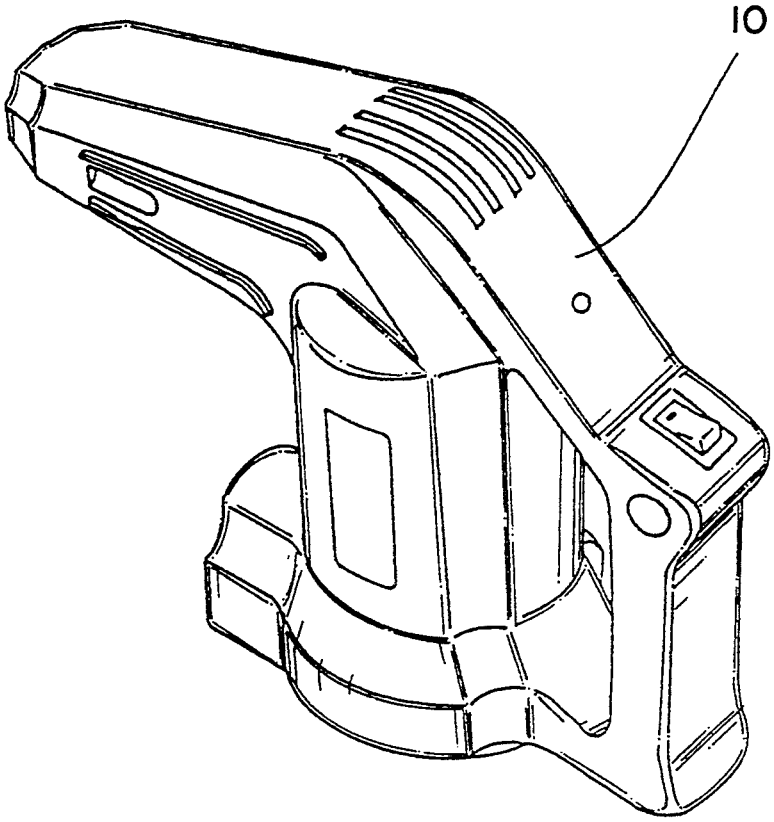
FIG. 1 is a perspective view showing a preferred embodiment of a portable car-used oil extracting and tire inflation apparatus with separately disposed oil and air pumps according to the present invention.
Figure 2:
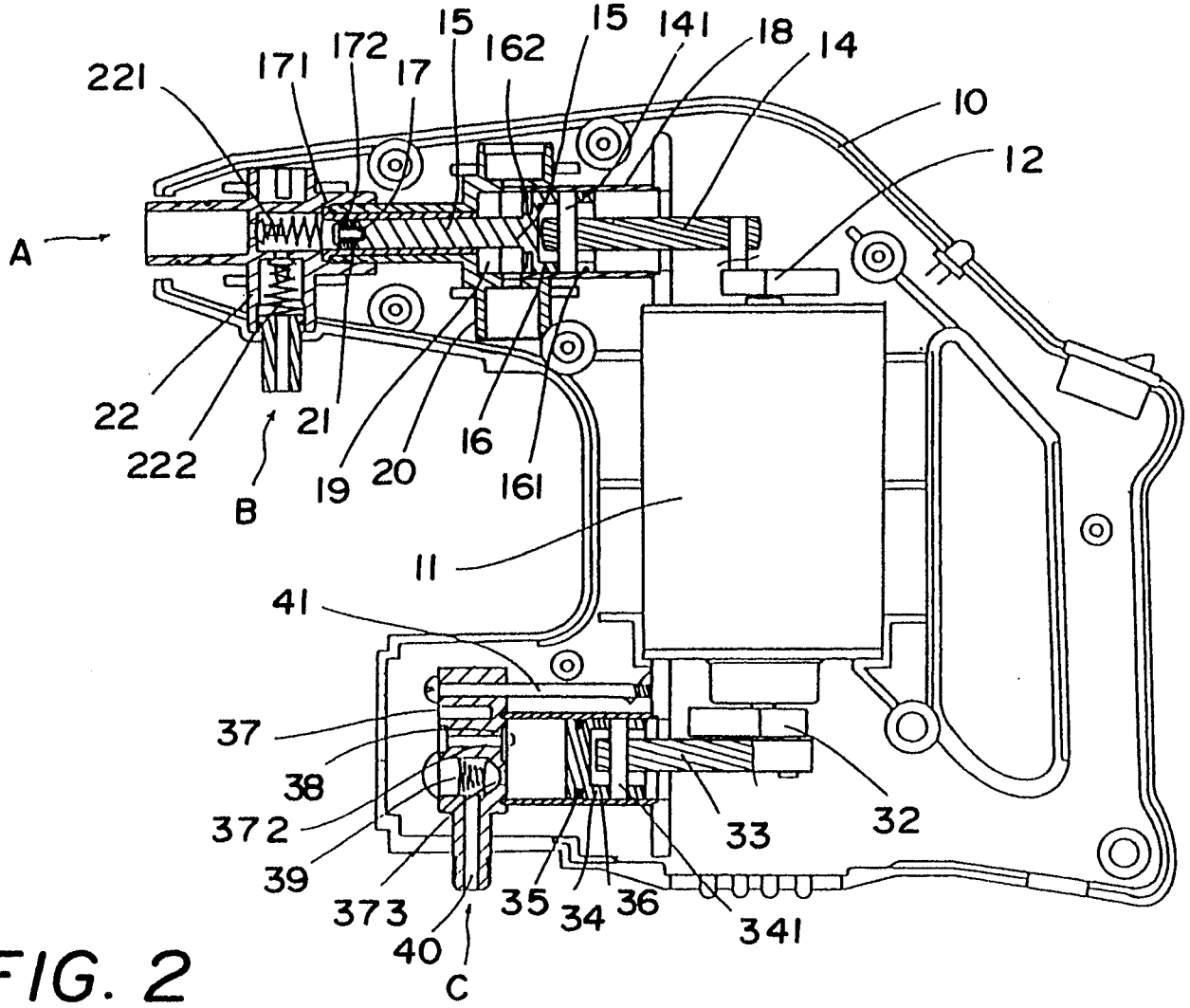
FIG. 2 is a vertical sectional view of a first embodiment of the present invention.
Figure 2A:
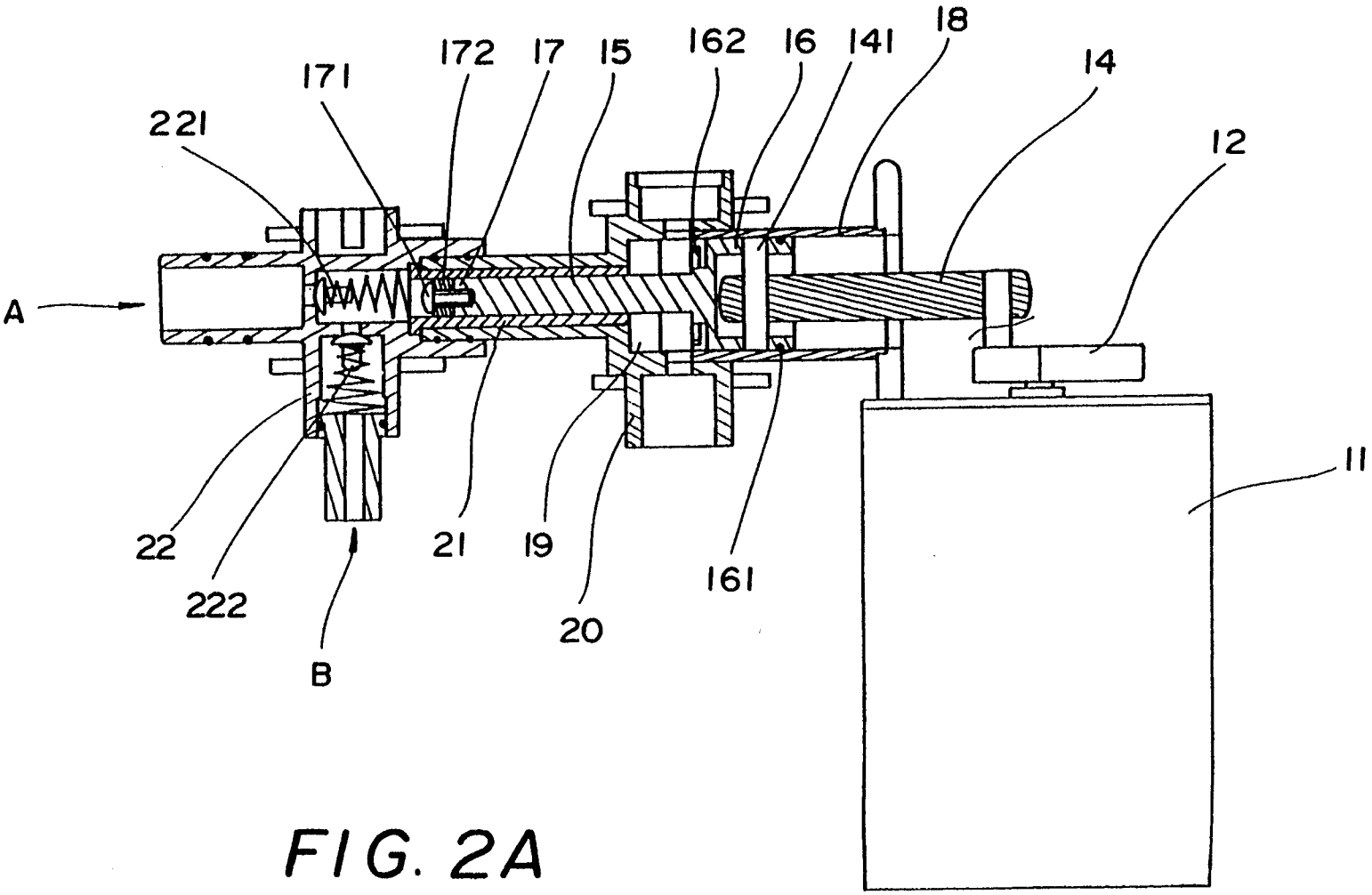
FIG. 2A is an enlarged sectional view of the oil pump assembly of FIG. 2.
Figure 3:
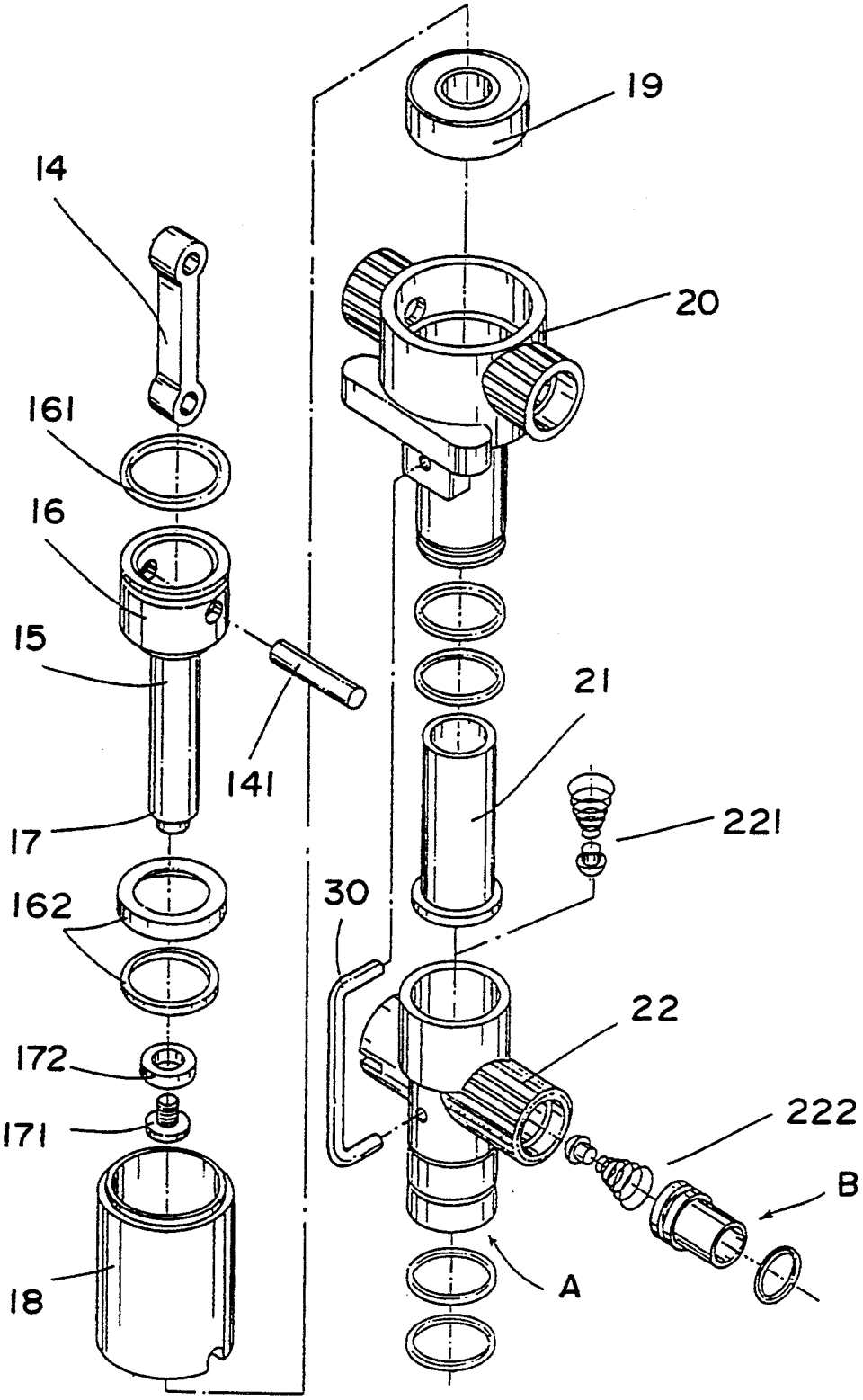
FIG. 3 is an exploded perspective view of an oil pump assembly of the preferred embodiment of the present invention.

Please refer to FIGS. 1, 2, and 3. The present invention mainly includes a kettle-shaped casing 10 having an upper front oil inlet opening A, an upper front oil outlet opening B, and a lower front air outlet opening C, as well as a rear handle; and a motor 11 fixed inside the casing 10 at a middle portion thereof. The motor 11 has at a top rotary shaft connected to a first eccentric crank member 12, and at a bottom rotary shaft connected to a second eccentric crank member 32. An an oil pump assembly is disposed inside the casing 10 at a top portion thereof; and an air pump assembly is disposed inside the casing 10 at a bottom portion thereof.

The oil pump assembly consists of a first rocker arm 14 of which a rear end is connected to the first eccentric crank member 12 by means of an eccentric pin; a rear oil piston 16 received in a first cylinder jacket 18 with its rear end connected to a front end of the first rocker arm 14 by means of a first connecting pin 141; a cylinder shaft 15 integrally formed at a front end of the rear oil piston 16; and a front oil piston 17 integrally formed at a front end of the piston rod 15 and having a graphite ring 172 fixed to its front end by means of a screw 171 shaft 15, the front oil piston 17 and the graphite ring 172 are all received in a second cylinder jacket 21 which is connected between a front pump body 22 and a rear pump body 20. When the motor 11 is started and the first eccentric crank member 12 is turned to pull or push the first rocker arm 14, the rear oil piston 16 and the front oil piston 17 reciprocate to and fro, together by the action of the first rocker arm 14. Moreover, a first O-ring 161 and a retainer 162 with a brass gasket are mounted over an outer periphery of the rear oil piston 16 to ensure the tight contact of the rear oil piston 16 with the first cylinder jacket 18.

The front ,oil pump body 22 has front and bottom openings respectively extending out of the oil inlet opening A and the oil outlet opening B of the casing 10; and the second cylinder jacket 21 has a hollow front portion extending into a rear opening of the front pump body 22 thereby communicating with oil chambers in the front pump body 22. Two uniflow valves 221, 222 are disposed inside the front pump body 22 to control the flow of the extracted oil into and out of the front pump body through the front and the bottom 10 openings thereof, respectively, in only one direction. An oil seal 19 is placed in the rear pump body 20 at the rear end of the second oil cylinder jacket 21 to prevent any oil leakage therefrom. Moreover, an oil duct 30 is provided that connects the front pump body 22 and the rear pump body 20 so that any extracted oil flowing into the rear pump body 20 can flow through the duct 30 and back to the front pump body 22 and be drained from the oil outlet opening B.

Figure 4:
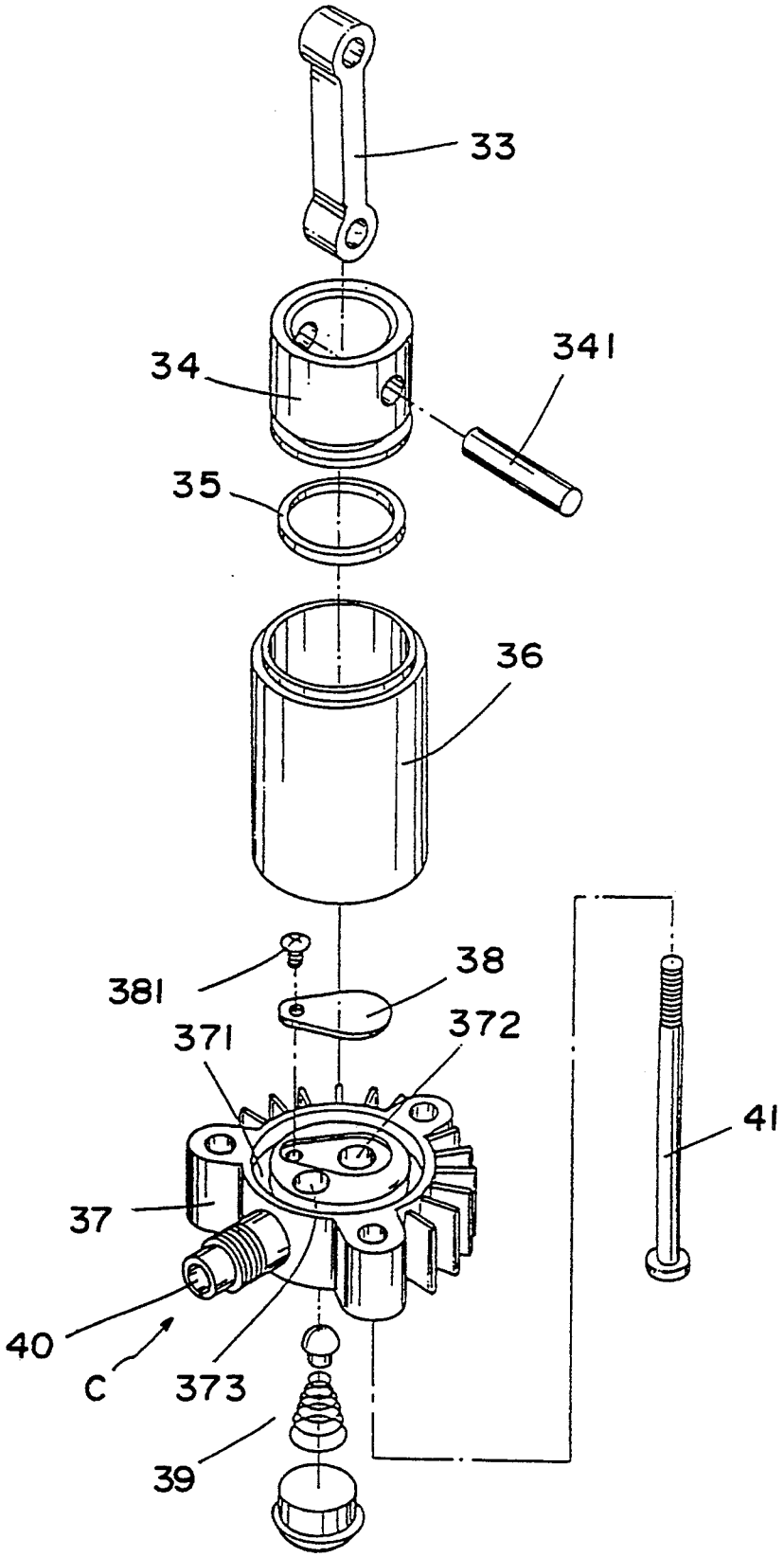
FIG. 4 is an exploded perspective view of an air pump assembly of the preferred embodiment of the present invention.

Please further refer to FIGS. 2 and 4. The air pump assembly consists of a second rocker arm 33 of which a rear end is connected to the second eccentric crank member 32 by means of an eccentric pin, so that a rotation movement of the motor 11 can be converted into a liner movement of the second rocker arm 33. The air pump assembly also includes an air piston 34, a rear end of which is connected to a front end of the second rocker arm 33 by, means of a second connecting pin 341; a third cylinder jacket 36 receiving the air piston 34 therein; a second O-ring 35 mounted near and over a front end of the air piston 34 to form a seal between the air piston 34 and the third cylinder jacket 36; and a cylinder cover 37. The cylinder cover has an annular groove 371 which receives a front end of the third cylinder jacket 36, and a central plate portion on an inner side of which an air inlet 372 and an air outlet 373 are separately provided. A thin spring leaf 38 is loosely fixed to a top of the air inlet 372 by means of a screw 381 such that the spring leaf 38 can be lifted when air is sucked into the third cylinder jacket 36 by the air piston 34. A uniflow air outlet valve 39 is disposed inside the air outlet 373 to control the flow of compressed air in one direction to an air inflation port 40 via the air outlet 373. The whole air pump assembly is fixedly mounted inside the casing 10 at the lower portion by means of long stem screws 41.

The present invention can be used to drain oil from a machine oil sump of a vehicle, by simply connecting an oil draining hose to the front opening of the front pump body 22 through the upper front oil inlet opening A of the casing 10 with the other end of the draining hose deeply extending into the bottom of the machine oil sump, and then switching on the motor 11. This results in first rocker arm 14 connected to the first eccentric crank member 12 causing the pistons 16 and 17 to reciprocate in a liner motion, and oil in the sump is extracted from the oil inlet opening A and drained from the oil outlet opening B. The present invention is can be used to inflate tires of a vehicle by simply connecting an inflation hose (which is a known means and will not be discussed herein) to the air inflation port 40 extending out of the lower front air outlet opening C of the casing 10, and then starting the motor 11. This activates the air pump assembly so that tires and other items can conveniently inflated.

As the above description, the apparatus according to the present invention is designed to employ one single motor to drive pistons of an upper oil pump assembly and a lower air pump assembly, each of which are connected to the motor via eccentric crank members to reciprocate to and fro. The oil pistons and the air piston of the oil pump and air pump, respectively, are mated with their corresponding cylinder jackets to generate pumping pressure to extract oil from an oil sump or to inflate tires, respectively. The oil duct 30 provided between the rear oil pump body 20 and the front oil pump body 22 near the oil outlet opening B can prevent oil leakage. Moreover, the entire oil cylinder has a power metallurgy structure and the front piston 17 is equipped with a graphite ring 172 both of which enable a long time operation time of the oil cylinder 10 without the risk of piston ring seizure. Hence, the present invention provides a light weight and portable apparatus which has an oil pump and an air pump at an upper and a lower portion of the apparatus, respectively, to perform the oil extracting or the tire inflation and is, therefore, very practical and safe in use.

Figure 5:
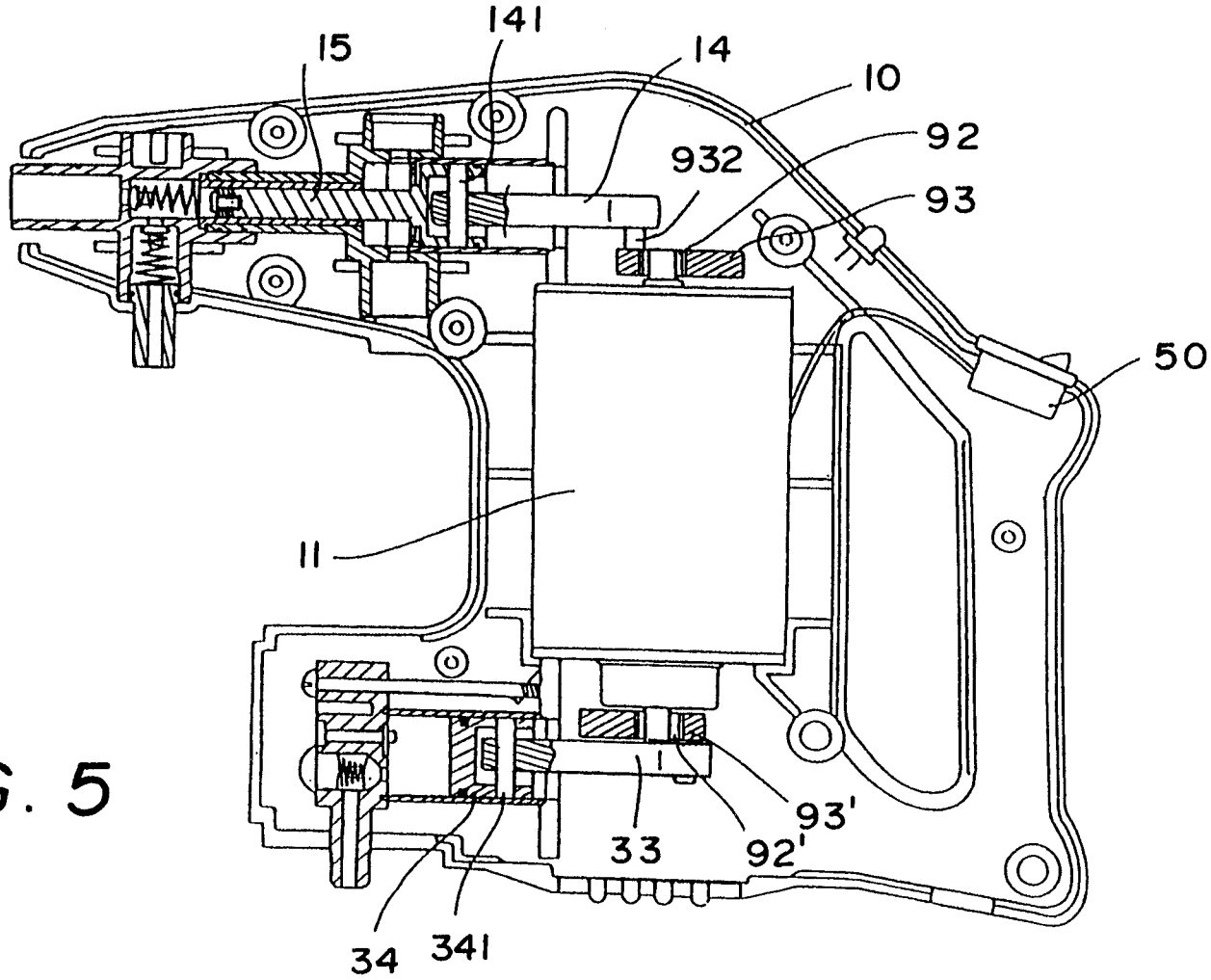
FIG. 5 is a vertical sectional view of a second embodiment of the present invention.
Figure 6:
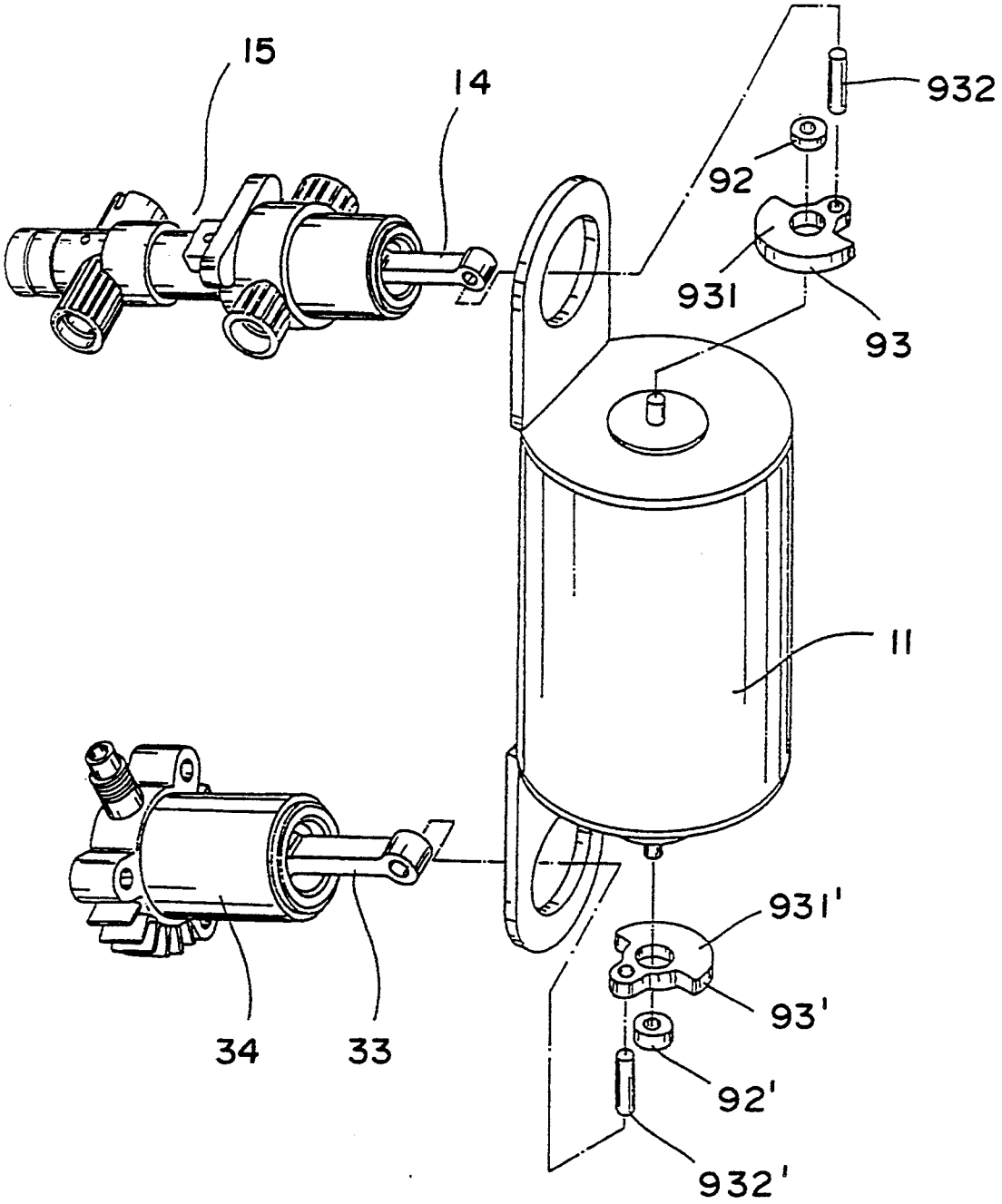
FIG. 6 is a partially exploded perspective view the second embodiment of the present invention.

Another embodiment of the present invention is shown in FIGS. 5 and 6, where the motor 11 providing power output is located at a middle portion of the casing 10 and is connected by a rotary shaft at each end thereof to a unidirectional bearing 92, 92'. The unidirectional bearings 92, 92' are further connected to a weighted eccentric crank member 93, 93', respectively. The weighted eccentric members 93, 93' each have a weighted plate portion 931, 931', and an eccentric connecting pin 932,932' fixed to an end on the weighted eccentric crank member 93, 93' opposite to the weighted plate portion 931, 931'. The eccentric connecting pins 932, 932' are respectively connected to the rear end of the first rocker arm 14 and the second rocker arm 33, while the first connecting pin 141 and the second connecting pin 341 are used to connect the front end of the first rocker arm 14 and the second rocker arm 33 to the rear oil piston 16 of the oil pump assembly and the air piston 34 of the air pump assembly, respectively.

The second embodiment of the present invention can be used to extract oil from a machine oil sump, by first pressing down a power switch 50, so that the motor 11 turns in a first direction and the motor shaft causes the weighted eccentric crank member 93 connected to the first rocker arm 14 to rotate. This results in eccentric connecting pin 932 moving the first rocker arm 14 connected thereto back and forth, actuating the oil pump assembly to extract oil.

The unidirectional bearing 92' and the weighted eccentric crank member 93' at the other end of the motor shaft is not driven to move at the same time as oil extracting and, therefore, the air piston 34 connected to the eccentric connecting pin 932' does not move at all. If the tire inflation is not necessary at this point, the power output that would be otherwise generated and supplied to the air piston 34 can therefore be saved.

When the power switch 50 is pressed down so that the motor 11 turns in a second reverse direction, the air piston 34 connected to the weighted eccentric crank member 93' via the second rocker arm 33 is driven to do reciprocating movement while the oil pump assembly connected to the weighted eccentric crank member 93 keeps still. By this way, the efficiency of energy of motion converted to power can be effectively controlled and enhanced.

In addition, when the rocker arm 14 or 33 is actuated by the weighted eccentric crank member 93 or 93', the force of inertria of the weighted eccentric crank member shall further rotate the flywheel and thereby enhances the horsepower output by the motor 11.

As the above description, the second embodiment of the present invention is characterized by that a unidirectional bearing and a weighted eccentric crank member are connected to both the upper and the lower rotary shafts of the motor 11, so that the operation of the motor 11 can only actuate either the oil pump assembly or the air pump assembly, and thereby save energy of motion which would otherwise be used to drive other mechanism, that is, the oil or the air pump assembly, that is actually not in use.

What is claimed is:

1. A portable car-used oil extracting and tire inflation apparatus with separately disposed oil and air pumps, comprising a casing, a motor disposed inside said casing at a middle portion thereof, an oil pump assembly connected to a first eccentric crank member that is connected to an upper rotary shaft of said motor, and an air pump assembly connected to a second eccentric crank member that is connected to a lower rotary shaft of said motor;

said oil pump assembly being disposed inside said casing at an upper front portion thereof and comprising a first rocker arm of which a rear end is connected to said first eccentric crank member by means of a first eccentric pin, a rear oil piston fixedly connected with said first rocker arm at a front end thereof by means of a first connecting pin and being received in a first cylinder jacket which is coupled with a rear pump body, a piston rod integrally formed In front of said rear oil piston and being received in a second cylinder jacket coupled between said rear pump body and a front pump body, and a front oil piston at a front end of said piston rod also being received in said second cylinder jacket; said front pump body having two uniflow valves disposed therein such that oil in a sump can be extracted into and then drained from said front pump body in only one direction;

said air pump assembly being disposed inside said casing at a lower front portion thereof and comprising a second rocker arm of which a rear end is connected to said second eccentric crank member by means of a second eccentric pin, an air piston fixedly connected with said second rocker arm at a front end thereof by means of a second connecting pin, a third cylinder jacket receiving said air piston therein, and a cylinder cover having an air inflation portion for connecting with an hose for tire inflation;

wherein said motor respectively turns said first and second eccentric crank member, and said first and second eccentric crank members respectively turn said first and said second rocker arms causing said first and second rocker arms to reciprocate back and forth in a linear motion, so that said oil and said air pump assemblies are actuated to automatically extract oil and inflate a tire, respectively.

2. A portable car-used oil extracting and tire inflation apparatus with separately disposed oil and air pumps as claimed in claim 1, wherein said oil pump assembly has an oil duct provided between said front and said rear pump bodies to prevent oil leakage from said rear pump body.

3. A portable car-used oil extracting and tire inflation apparatus with separately disposed oil and air pumps as claimed in claim 1, wherein said cylinder cover of said air pump assembly has an air inlet and an air outlet formed thereon, said air inlet having a thin spring leaf loosely screwed thereto at a side facing said air piston, and said air outlet having a uniflow valve disposed therein so that air inside said third cylinder jacket can only flow in one direction to said air inflation port.

4. A portable car-used oil extracting and tire inflation apparatus with separately disposed oil and air pumps as claimed in claim 1, wherein said casing is provided with a handle.

5. A portable car-used oil extracting and tire inflation apparatus with separately disposed oil and air pumps as claimed in claim 1, wherein said oil cylinder of said oil pump assembly has a powder metallurgy structure.

6. A portable car-used oil extracting and tire inflation apparatus with separately disposed oil and air pumps as claimed in claim 1, wherein said front oil piston is equipped with a graphite piston ring.

* * * * *